US006435342B1

(12) United States Patent
Agnes

(10) Patent No.: US 6,435,342 B1
(45) Date of Patent: Aug. 20, 2002

(54) PACKAGING OF SMOKING ARTICLES

(75) Inventor: Hjarald Edgar Agnes, Amstelveen (NL)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/646,887

(22) PCT Filed: Apr. 7, 1999

(86) PCT No.: PCT/GB99/01058

§ 371 (c)(1),
(2), (4) Date: Dec. 1, 2000

(87) PCT Pub. No.: WO99/52791

PCT Pub. Date: Oct. 21, 1999

(30) Foreign Application Priority Data

Apr. 9, 1998 (GB) ..... 9807771

(51) Int. Cl.[7] ..... B65D 85/10
(52) U.S. Cl. ..... 206/268; 206/273; 229/160.1
(58) Field of Search ..... 206/268, 263, 206/264, 273; 229/160.1

(56) References Cited

U.S. PATENT DOCUMENTS

| | | | | |
|---|---|---|---|---|
| 1,892,111 A | * | 12/1932 | Molins | 206/268 |
| 2,013,646 A | | 9/1935 | Andrews | |
| 3,165,249 A | * | 1/1965 | Peck | 206/268 |
| 3,596,823 A | * | 8/1971 | Zitzelman | 206/268 |
| 3,765,593 A | * | 10/1973 | D'Alessio | 206/268 |
| 4,534,463 A | | 8/1985 | Bouchard | |
| 4,570,790 A | | 2/1986 | Turnage | |
| 4,607,748 A | * | 8/1986 | Focke | 206/273 |
| 4,715,497 A | * | 12/1987 | Focke et al. | 206/264 |
| 4,763,779 A | | 8/1988 | Focke et al. | |
| 5,080,227 A | | 1/1992 | Focke | |
| 5,344,008 A | | 9/1994 | DeBlasio et al. | |

FOREIGN PATENT DOCUMENTS

| | | |
|---|---|---|
| DE | 2408879 | 9/1975 |
| DE | 3345586 A | 6/1985 |
| GB | 285778 | 2/1928 |

* cited by examiner

*Primary Examiner*—Bryon P. Gehman
(74) *Attorney, Agent, or Firm*—Jones, Tullar & Cooper, P.C.

(57) ABSTRACT

A pack for cigarettes and the like has the action of a conventional "flip-top" hinge-lid pack. Cigarettes (22) inside the pack are arranged with the axes parallel to the axis of pivot (10) of the lid (3) and are presented when the lid is open in an enclosure formed by a liner (13) of the pack, with a side wall (16) preventing sideways escape of the cigarettes but with an access opening allowing withdrawal of cigarettes by movement along their axis (24).

10 Claims, 9 Drawing Sheets

Fig.1.
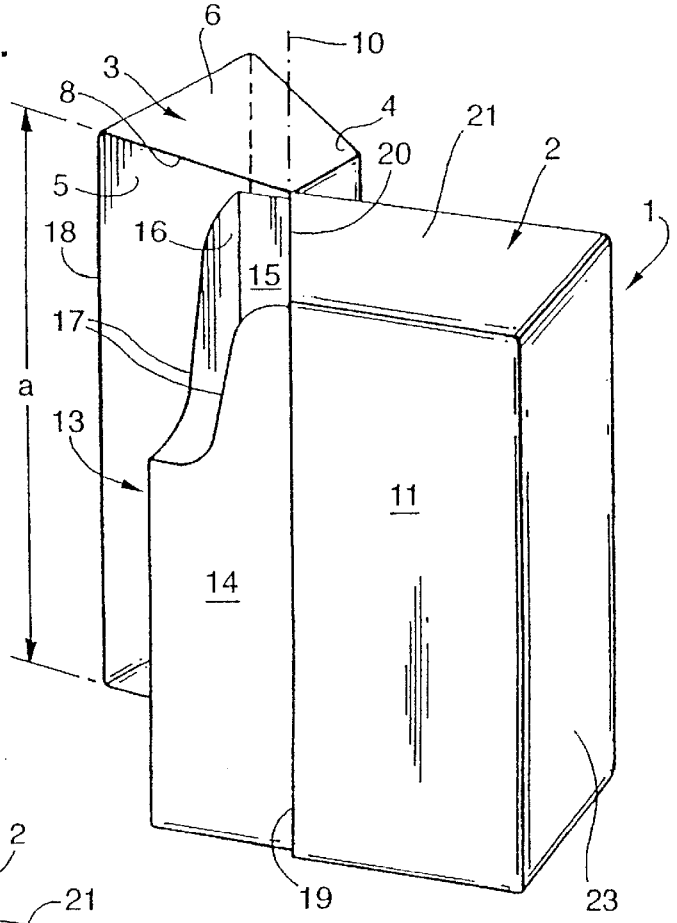
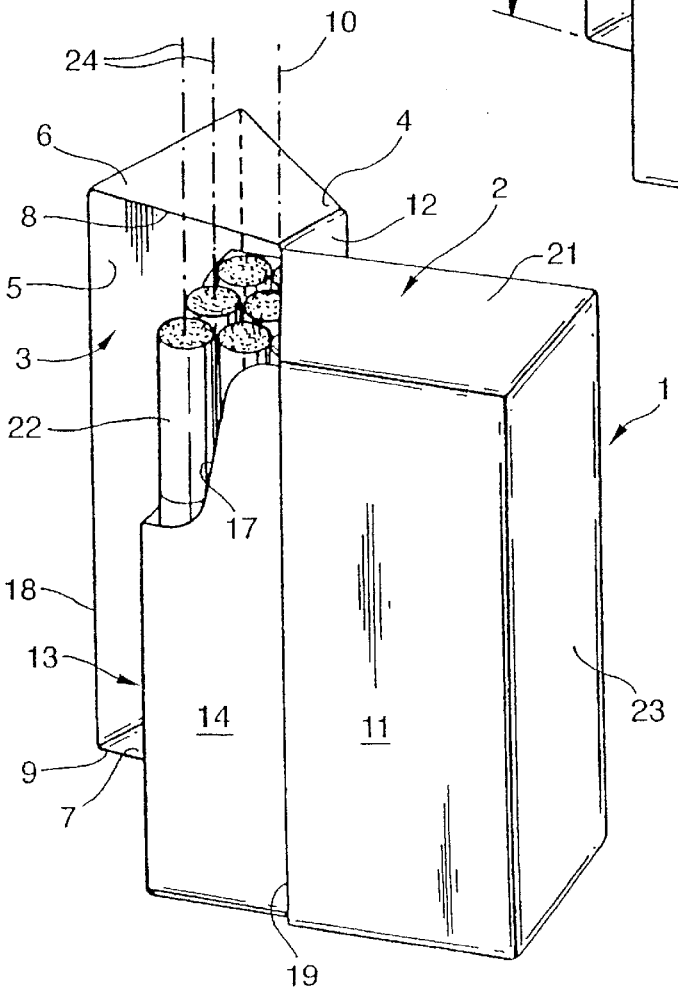
Fig.2.

PACKAGING OF SMOKING ARTICLES

BACKGROUND OF THE INVENTION

1. Field of the Invention

The present invention relates to packaging of smoking articles and provides a pack for such articles, as well as a pack charged with them. It relates to a pack in which cigarettes are positioned with their axes parallel to the axis of a hinge of a lid of the pack.

2. Description of the Prior Art

DE-A-3345586 shows a proposal for such a pack. Cigarettes are held in a pack parallel to a hinge axis between its halves and which when opened exposes the interior of both halves to the user. Both may contain cigarettes. An open inner frame is provided which as drawn in FIG. 4 would prevent opening or closing of the pack. See also the multi-part hinged pack disclosed in U.S. Pat. No. 5,344,008.

There are also packs in which the charge of cigarettes is held in a drawer-like inner slide part which moves in a shell outer in directions perpendicular to the axis of the cigarettes. See, for example, U.S. Pat. Nos. 5,080,227, 4,534,463 and GB-A-285778. However, it is a feature common to all these that an end wall of the drawer forms the closure to the pack and there is no hinged lid.

Cigarette shoulder boxes are described in U.S. Pat. No. 4,763,779 and U.S. Pat. No. 4,570,790. These boxes comprise a box portion and a hinged lid connected to the box portion along an axis of articulation. The axis of articulation is normally along an edge of a longitudinal side wall of the box or is a fold line which is located parallel to the edge of the box, the fold-line usually being in the middle of the width of the side panel. The enclosed articles are held within the box which is uncovered upon articulation of the lid about the fold line. These boxes do not require an enclosure as their upper surface is open when the box articulated along the fold line.

SUMMARY OF THE INVENTION

The pack of the present invention has a conformation which externally resembles that of a conventional "flip-top" pack. In such packs, however, it is conventional for the smoking article such as cigars, cigarettes, or cigarillos (hereinafter referred to for convenience as "cigarettes") to be presented with their long axes i.e. the axis of the cylindrical body perpendicular to the axis of the hinge. When the top is opened by rotation about the hinge line what the user sees is the circular ends of the array of cigarettes and these cigarettes can be removed from the pack by movement along their axis, perpendicular to the hinge axis, and usually in a region towards the centre of the width of the pack. Usually in a flip-top box the major axis of the pack as a whole is parallel to the axes of the cigarettes contained in it.

In the present invention the pack is adapted to receive a charge of cigarettes which have their axes parallel to the axis of the hinge of the lid of the pack, and has a liner portion of the pack partially enclosing the charge of cigarettes and preventing sideways escape from the pack but offering an actual or potential access opening for the removal of a cigarette from the pack in a direction generally parallel to the hinge axis, when the lid is open, in a region adjacent to one side of the pack.

The present invention provides a pack for smoking articles which have an axis of elongation, the pack being a container having a body and a lid hinged to the body about a hinge axis parallel to that of the smoking articles, the hinge axis being located in the plane or very closely adjacent to the plane of a major front or rear panel of the body and a liner located within the body, the liner forming an enclosure for the articles, characterised in that the enclosure is formed of front, rear, side and base walls of the liner, and projects from one side of the body to be closable by the lid in a closed position of the lid but accessible in an opened position of the lid, the enclosure enclosing the articles but offering an access opening for the removal of a smoking article from the pack in a direction generally parallel to the hinge axis.

BRIEF DESCRIPTION OF THE DRAWINGS

Particular embodiments of the invention are described with reference to the accompanying drawings, wherein:

FIG. 1 shows an assembled pack empty and with the lid open;

FIG. 2 shows the pack containing a charge of cigarettes and open;

DETAILED DESCRIPTION

Figure 3:
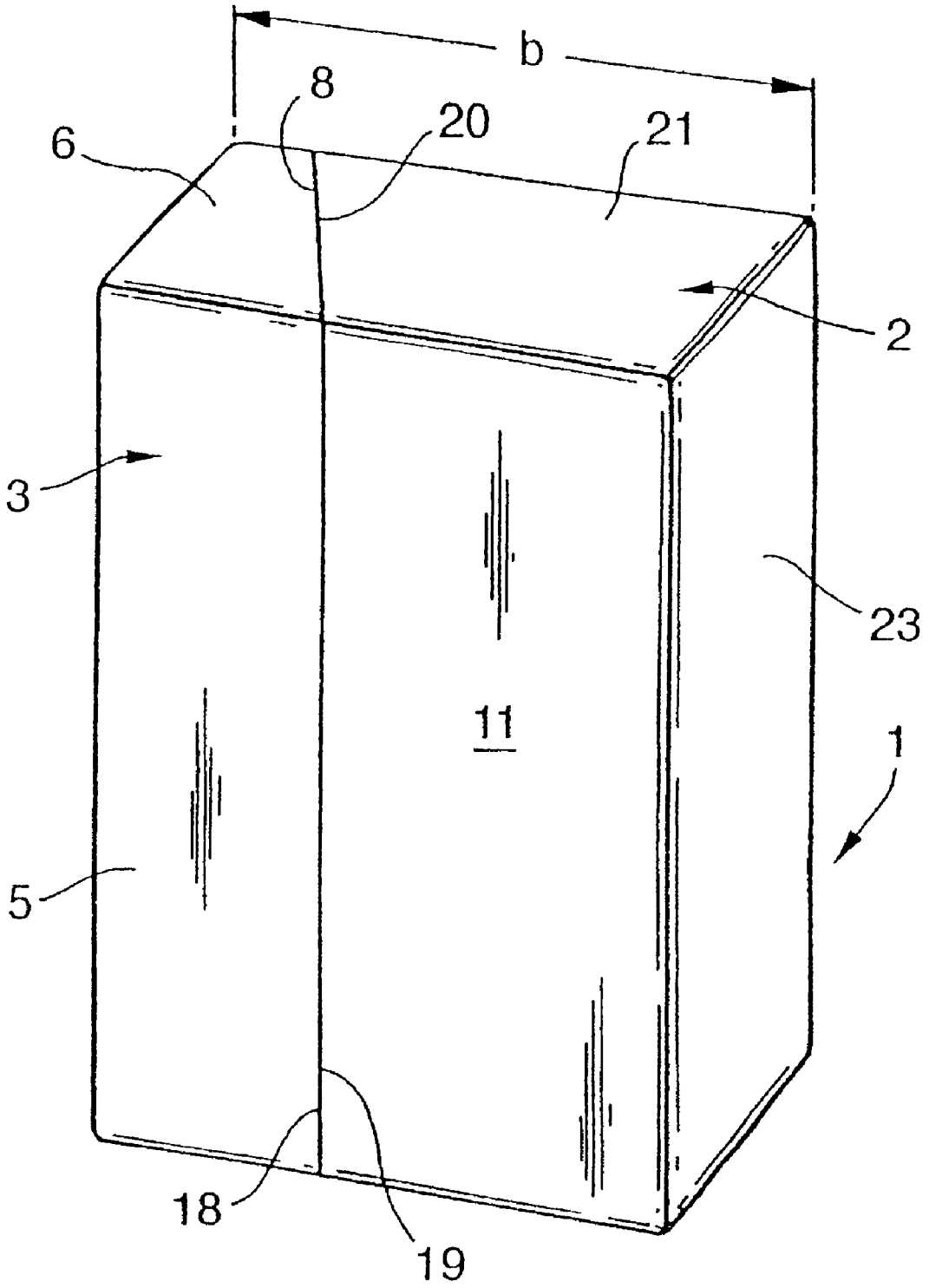
FIG. 3 shows the pack in closed condition.

Referring first to FIGS. 1 to 3, a container of a pack 1 is made in a substantially conventional manner from folded card or the like to provide a container having a body 2 and a lid 3, the lid 3 having an end wall 4, a front wall 5 and top and bottom walls 6,7. Top and bottom walls 6,7 of the lid 3 each have a sloping edge 8,9. With the arrangement of the body 2 and the lid 3 the pack 1 resembles generally in shape and in action a conventional "flip-top" pack. However, the proportions of the pack will usually be different from those conventional for a flip-top pack in that its major dimension a is parallel to an axis 10 about which the lid 3 pivots relative to the body 2. (In conventional flip-top packs the dimension b (FIG. 3) from the top of the lid to the opposite end wall is usually the major dimension).

The body 2 of the container is cuboid and comprises a major front panel 11 to which is parallel a major back panel, in the plane of which back panel or very closely adjacent to the plane of which back panel lies the hinge axis 10. The major back panel continues into a back wall 12 of the lid 3 of the container.

Within the body 2 of the container there is inserted a liner 13 arranged to project at least into the portion of the body 2 which is exposed when the lid 3 is opened, as in FIG. 1. The liner 13 has a front wall 14 which lies within and abuts face-to-face with at least part of the inner surface of the major front wall 11 of the body 2, and a rear wall 15 (FIG. 1) which lies within and abuts face-to-face with at least part of the inner surface of the major back panel of the body 2 of the container. Joining the front and rear walls 14 and 15 is an enclosure-forming side wall 16. The liner 13 also has a base (not shown in these Figures).

The projecting part of the liner 13 has no top wall, and the top corners of the front wall 14 and side wall 16 of liner 13 are both cut away in an open S shape as seen at 17 in FIGS.

1 and 2. Thus an access opening to the contents of the container is formed at a corner portion of the enclosure of the pack 1, when the lid 3 is open. Of course, when the lid 3 is closed as seen in FIG. 3 there is no access to the interior of the pack 1 or its contents: an edge 18 of the front wall 5 of the lid 3 abuts an edge 19 of the front wall 11 of the body 2 of the container, and sloping edges 8, 9 abut against sloping edge 20 of a top wall 21 and of a base wall (not shown in these Figures) of the body 2.

The contents of the pack 1 are intended to be a charge of (for example) twenty cigarettes, part of which charge is seen at 22 in FIG. 2. The charge may be cigarettes only, a foil-wrapped bundle of cigarettes or a part-foil-wrapped bundle, for example. The charge may be inserted as a whole together with the liner 13 from one side or other of a pack during its erection, or inserted as a charge into a pack pre-assembled with the liner 13, while conventional end closure flaps at side wall 23 of the body 2 are open at an intermediate stage of erection of the pack. Once assembled, it is not intended that the liner 13 should be moved for the extraction of cigarettes, or otherwise. The liner 13 may be a strong interference fit within the body 2, or preferably will be adhered or heat-sealed to it.

The central axes 24 of the cigarettes lie parallel to the hinge axis 10 of the lid 3 and also in this case to the major dimension a of the pack. When the lid 3 is open as seen in FIG. 2, the user may remove a cigarette through the access opening, by a movement along an axis 24 after removing at least the top corner of any foil or other wrapping of the cigarettes. Most conveniently the cigarette removed will be the one nearest to the corner, i.e. in the most cutaway portion of the curves 17, since this portion gives easiest access to the fingers of the user. The pack 1 can then be reclosed by a normal pivoting movement of the lid 3 about the hinge axis 10 with the liner 13 acting in the manner of the frame of a conventional flip-top pack, to exert frictional and/or an over-centre action on the lid 3 as the lid 3 moves.

Although the above description will suffice for the skilled person to make the pack, some preferred blanks for containers and liners will be described now. All are made of conventional sheet material such as card. Any of the liners are usable with any of the containers, and any may be used either with insertion of a charge of cigarettes into a preassembled liner or container, or by being assembled, wholly or partially, around a charge. All may be left-handed or right-handed; that is, with the lid open and away from the user, the access opening may be at the top right or top left of the pack. In many cases this can be achieved by moving the cuts 17 to a different corner of the liner.

Figure 4:
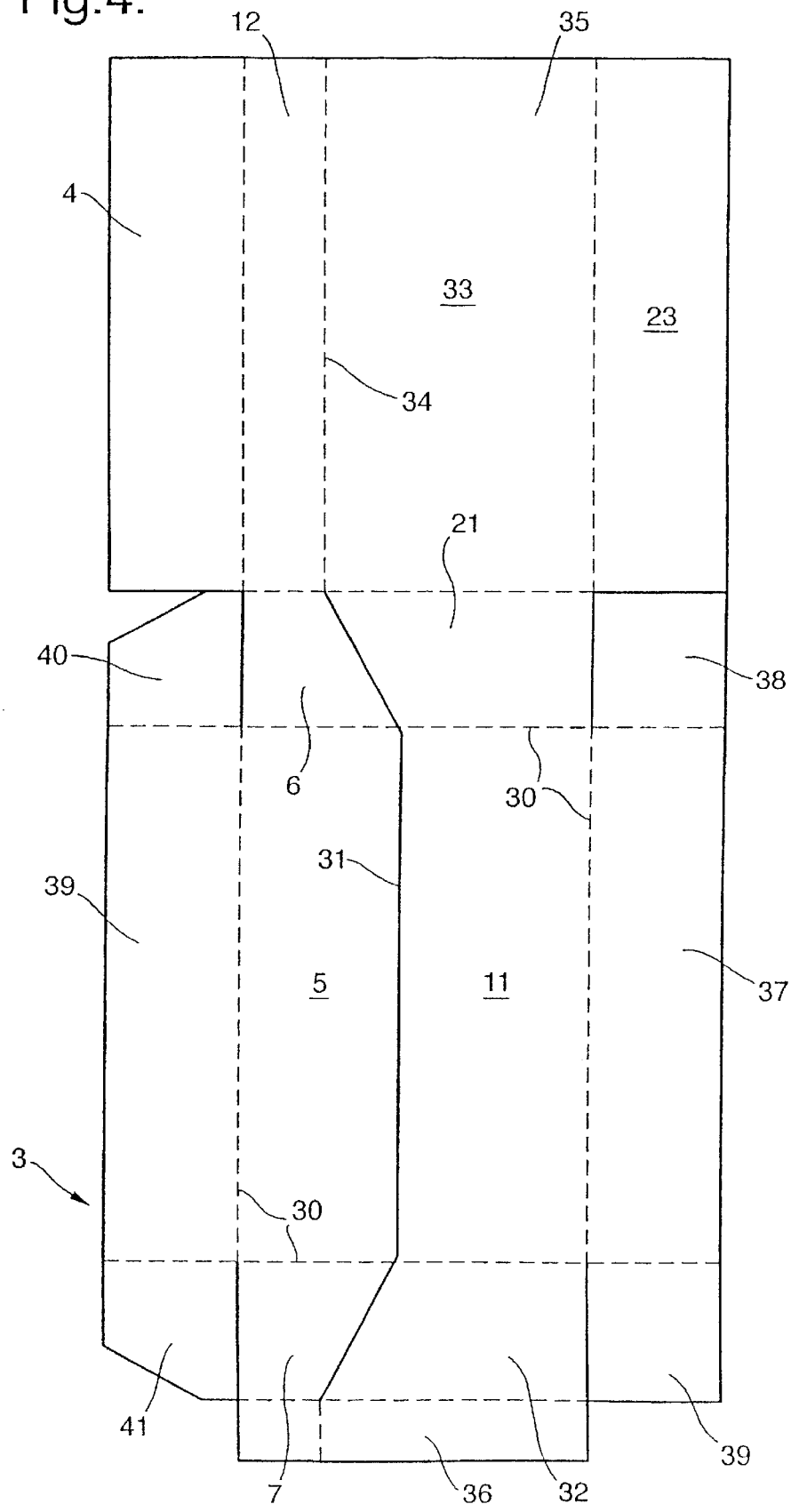
FIGS. 4 and 5 show the inner face of blanks for two embodiments of the body and lid of a container according to the present invention.
Figure 5:
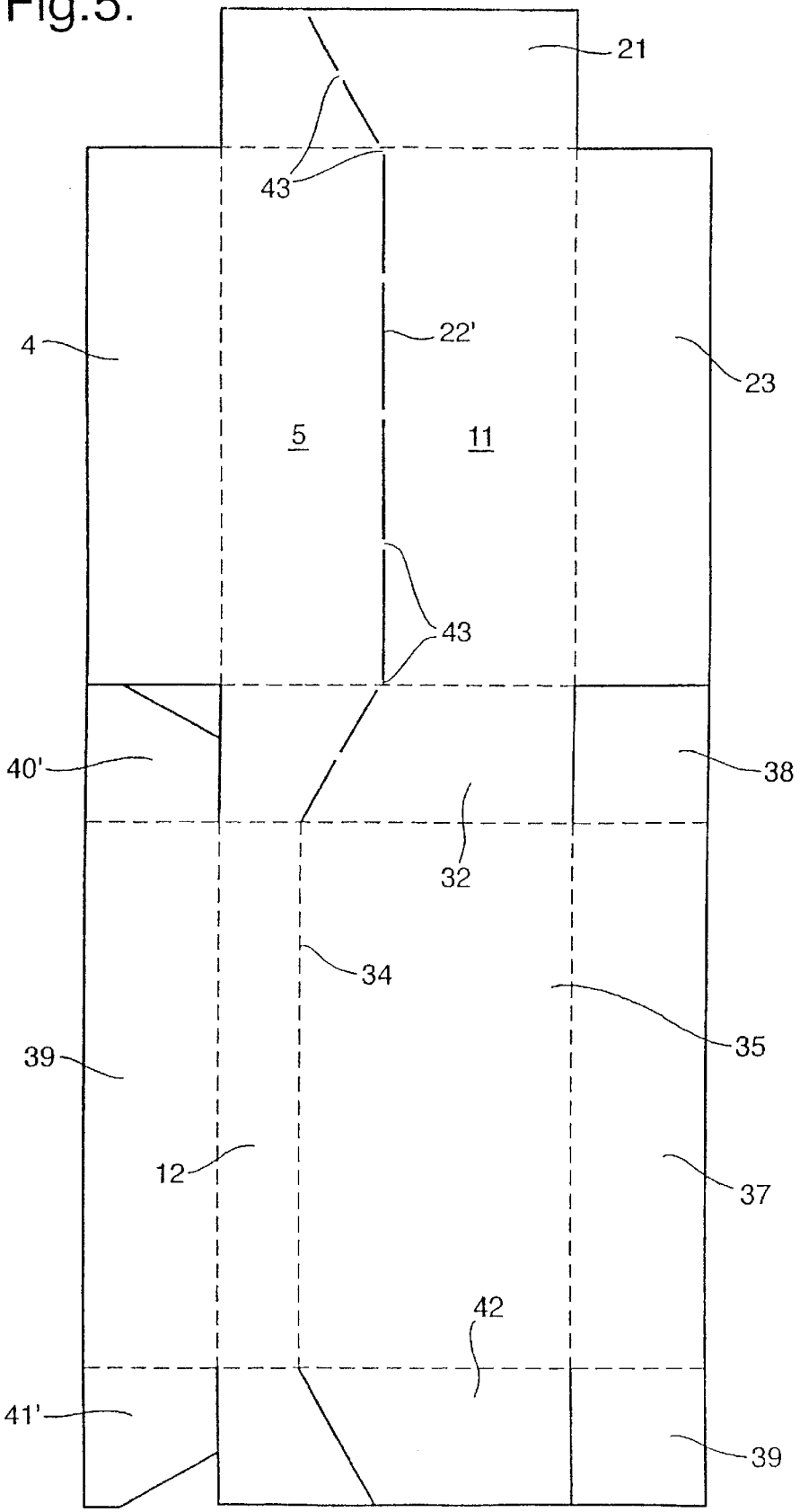

FIGS. 4 and 5 show blanks for containers which assembled by folding perpendicular to the axes of cigarettes of a charge which it contains or is to contain i.e. the charge may be positioned with a pre-erected liner for the container to be assembled therearound, or inserted with a liner after erection of the container, or both liner and container may be successively assembled around a charge.

In FIG. 4 fold lines 30 define a front wall 11 of a body of the container and a front wall 5 of a lid 3 of the container, separated by cut line 31. The cut line 31 continues at a slant into top and bottom panels 21, 32 of the body of the container and further defines top and bottom walls 6, 7 of the lid 3 of the container.

Rear panel 33 of the blank includes a hinge line 34 for the lid 3, dividing a rear wall 12 of the lid 3 from a rear wall 35 of the body of the container. Bottom panel 32 has a tab 36 which is to be joined to the inside of. rear panel 33. A side wall of the body is formed by overlying side panels 23, 37 of the blank, with corners strengthened by inturned end tabs 38, 39.

The lid is assembled by adhesion of tab 36 to the inside of the rear wall 35 of the body and also to the inner surface of the rear wall 12 of the lid. Top and bottom walls 6, 7 of the lid are formed with end tabs 40, 41 of the panel 39 adhered to the inner surface of top and bottom walls 6, 7 of the lid to strengthen them. Once erected appropriately and secured together, a container is obtained having the appearance of FIG. 3.

FIG. 5 is very similar except that tab 36 is omitted, with top (or bottom) wall panel 21, 32 being repeated at 42 for securing under its counterpart 21. If cut line 22' goes to an edge of the blank, as shown, it is made incomplete, pips or lands 43 of uncut material being left at the ends of the cut and in each panel. Corner tabs 40', 41' are here shown on panel 39 and corner tabs 38', 39' on panel 37.

Figure 6:
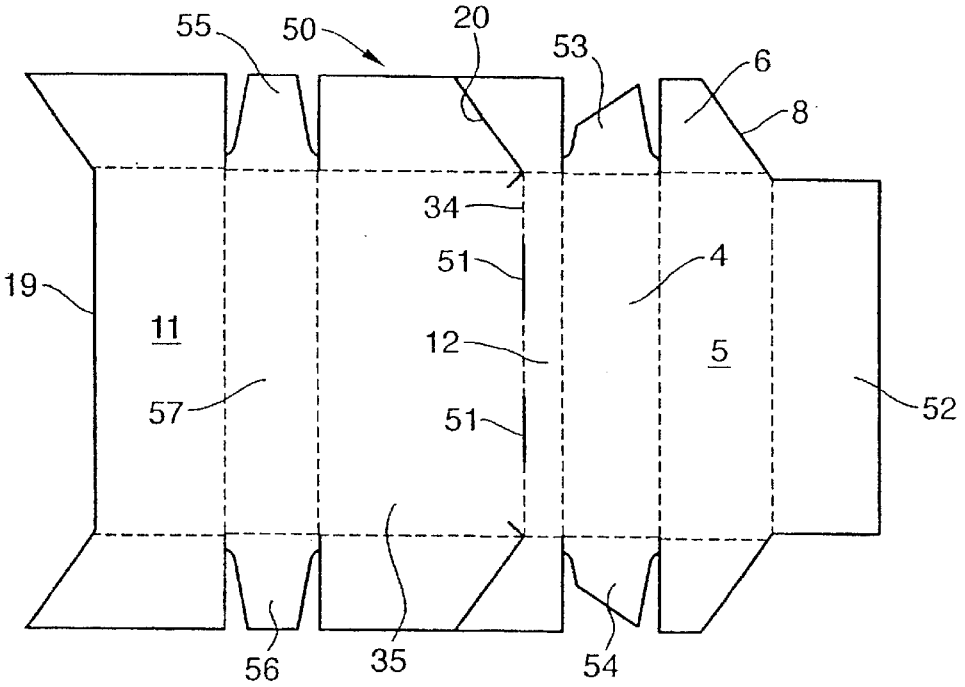
FIGS. 6 and 7 show the inner face of blanks for respective further embodiments of body and lid of a container according to the present invention.

A blank 50 for a further embodiment of container is seen in FIG. 6. It is a blank of which the main panels are folded about axes parallel to those of the cigarettes it contains or will contain. A rear panel 35 is joined to front panel 11 through side panel 57, and has a portion defined, at one extent, by hinge line 34, which may include partial cuts 51, which portion is the rear wall 12 of the lid, the side and front walls of which lid are provided by panels 4 and 5. A flap 52 attached to panel 5 is to be folded back through 180° and secured under panel 5 to define edge 18 and providing stiffening for the front wall of the lid. The container is erected in the conventional way, with securing together of top and base panels of the body and of the lid, respectively. Tabs 53, 54 on the lid, side wall 4 and tabs 55, 56 on the base panel 57 of the body part will fold to underlie the respective top and base walls thus formed.

Figure 7:
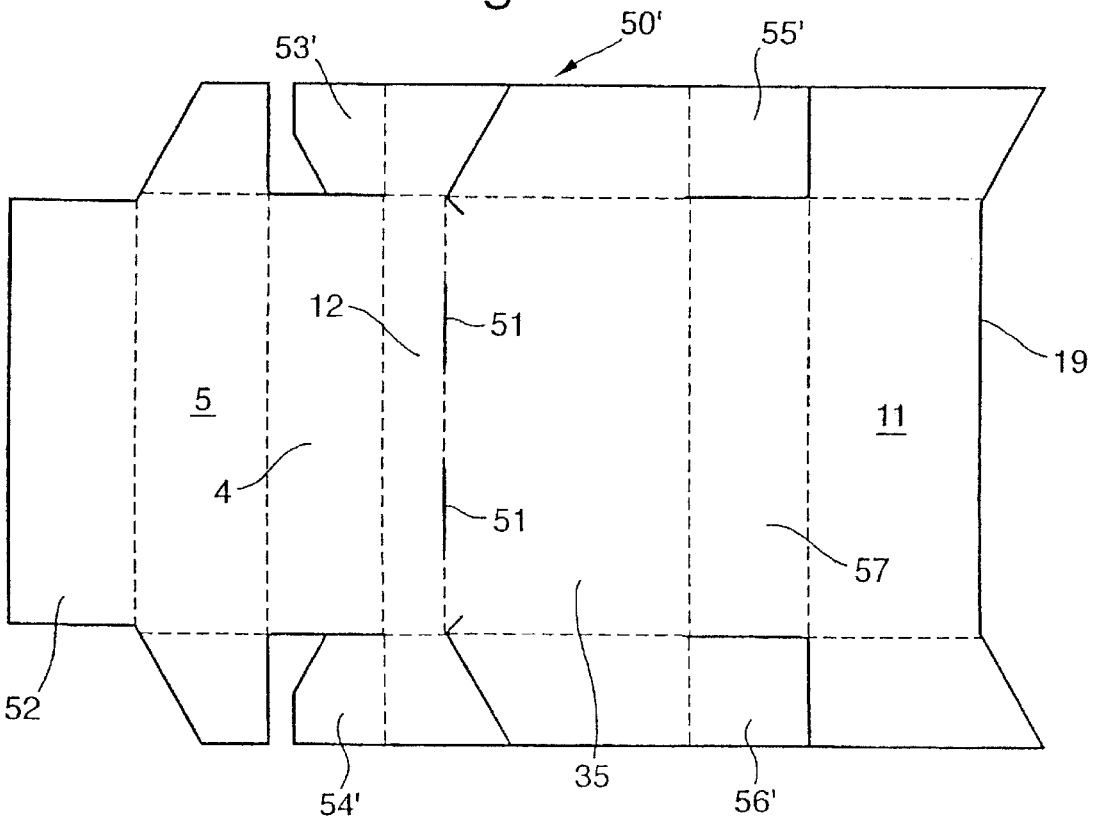

Blank 50' shown in FIG. 7 is similar except that tabs 53', 54' on the lid and 55', 56' on the body are provided on top and base walls and will underlie their end walls respectively. All of these containers when erected will resemble that seen in FIGS. 1 to 3.

Figure 8:
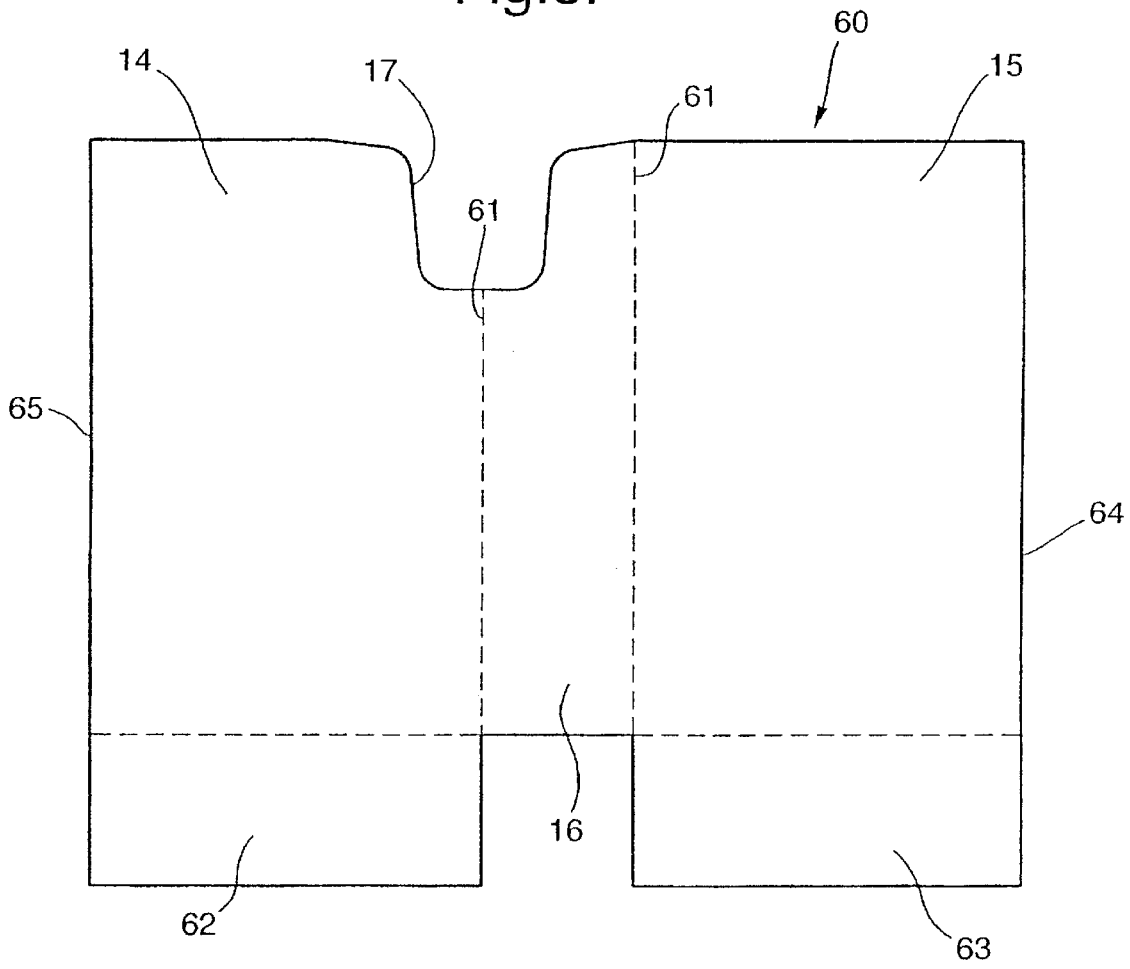
FIGS. 8 to 12 show the inner face of blanks for respective embodiments of liner.

FIG. 8 shows a first blank 60 for a liner. Front and rear panels 14, 15 are joined through fold lines 61 by a side wall 16. The cut away 17 in and towards the corner edge between the front and side walls 14, 16 reduces the height of that corner edge in the erected state and offers finger access. A base of the liner is formed by folding panels 62, 63 to overlie each other. The width of the front and rear panels is such that when erected (and enclosing a charge of cigarettes) and pushed home into a container so that the free edges 64, 65 abut the side wall of the body of the container, a portion of the front panel projects beyond the lip of the front wall of the body as shown in FIGS. 1 and 2, and the projecting enclosure as a whole acts analogously to the inner frame of a conventional flip-flop box, namely to provide a frictional and/or over-centre action on the lid as the lid is hinged to or from its closed and open positions, while at the same time offering access to the user to withdraw cigarettes in a direction parallel to the hinge axis 10 of the container and restraining cigarettes from sideways escape from the enclosure by means of side wall 16.

Figure 9:
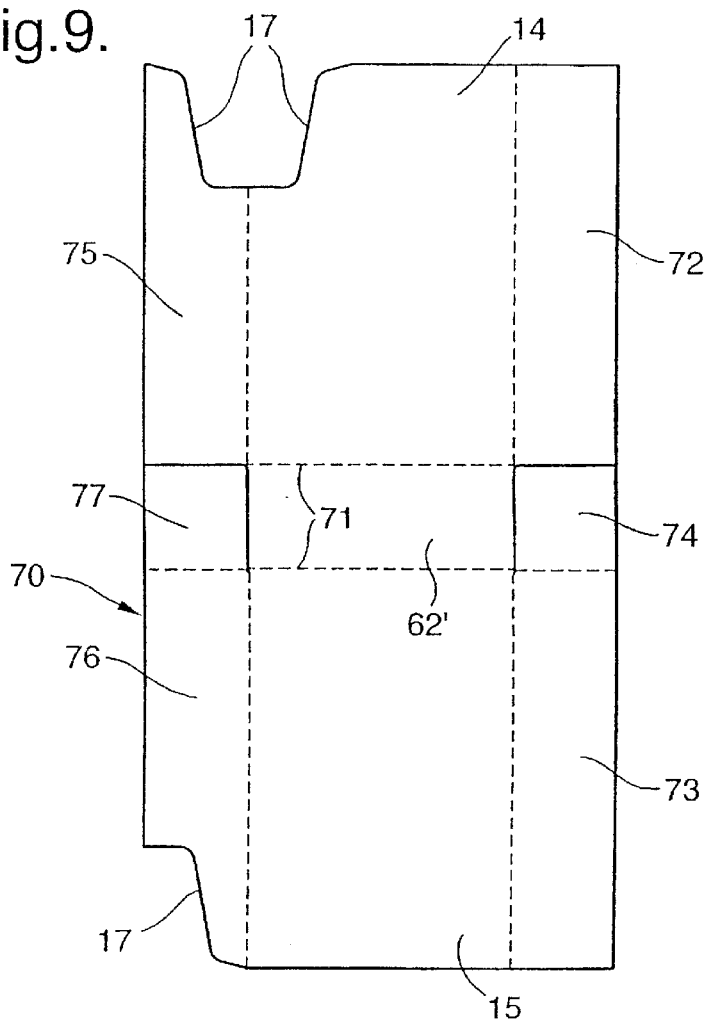

FIG. 9 shows a blank 70 for a liner in which front and rear panels 14,15 are joined at their minor edges by base panel 62', through hinge lines 71. A first side wall is formed by overlying panels 72, 73, with end tab 74 tucked in, and the second side wall of the enclosure is formed by overlying panels 75, 76, having corresponding S-cuts 17 in one end and in the front panel adapted to form a finger access opening. End tab 77 on panel 76 is tucked in.

Figure 10:
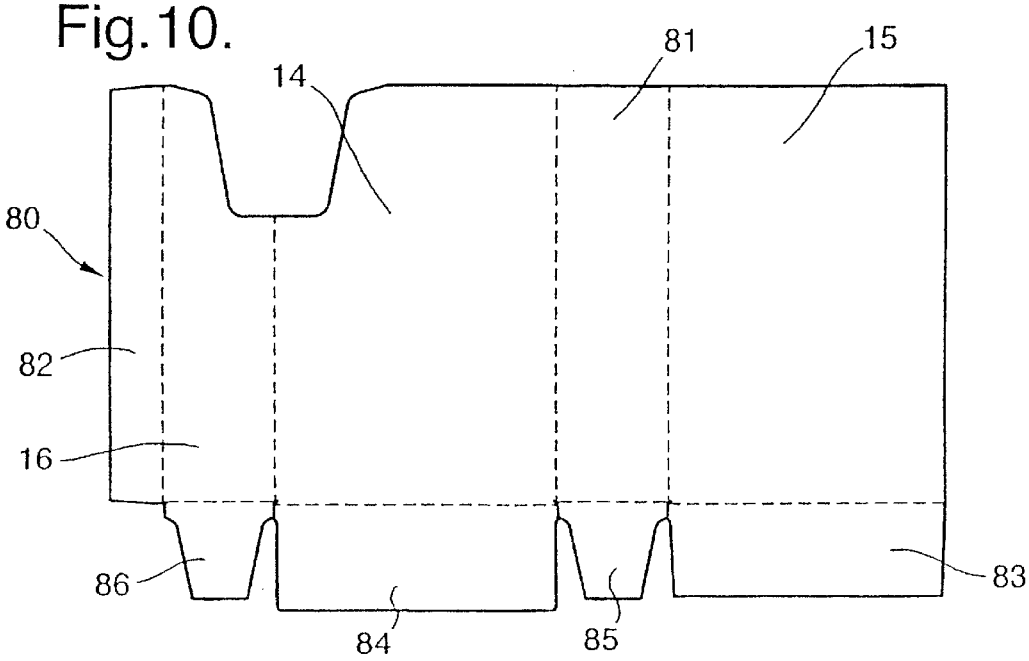

FIG. 10 shows a blank 80 for a liner in which, as in FIG. 8, front and rear panels 14,15 are joined at major edges, through a first side panel 81 and respective hinge lines. However, the first side panel 81 is not one forming part of the projecting enclosure. That side panel 16 is hingedly joined to the other major edge of the front panel, with tab 82 beyond it for securing to the inside of the far edge of rear panel 15. A base of the liner is formed of panel 83, and tabs 85, 86 infolded and underlain by second panel 84. As before, reduced height of the exposed side panel and front panel offer a finger access at the corner between them.

Figure 11:
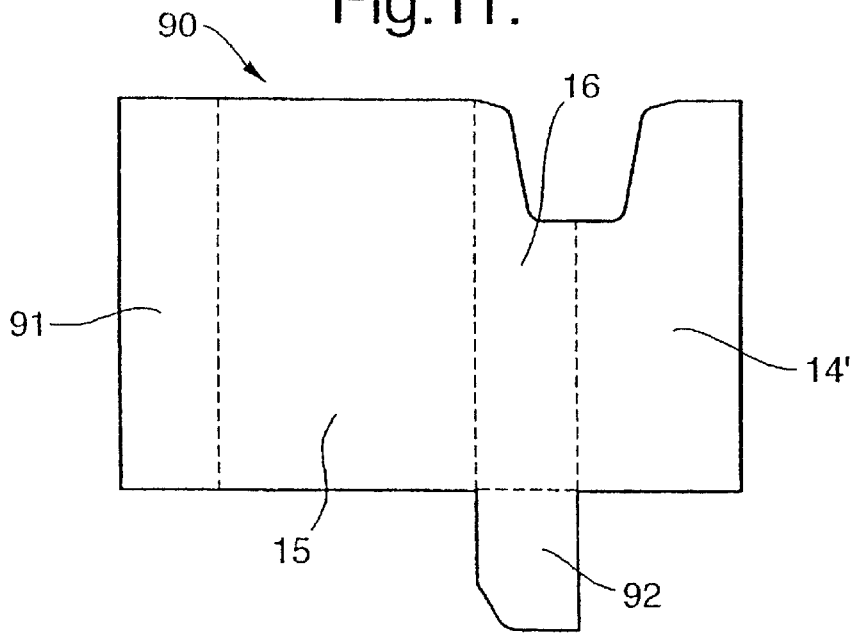

A simple embodiment of liner blank 90 is seen in FIG. 11. Back panel 15 is joined at its major edge by side wall panel 16 through respective hinge lines to a partial rear panel 14'. A flap 91 on the opposite major edge of the back panel 15 forms a side panel to be parallel to panel 16. A partial base for the liner, extending over little more than its projecting portion, is afforded by flap 92 at the base end of the side panel 16. When infolded, the free end of the flap 92 will rest on the base of the body of the container.

In any of the embodiments, a liner may have a top wall also, provided that it does not close off the access opening offered by the enclosure, at least not permanently (a removable top wall portion could be provided in that area).

Figure 12:
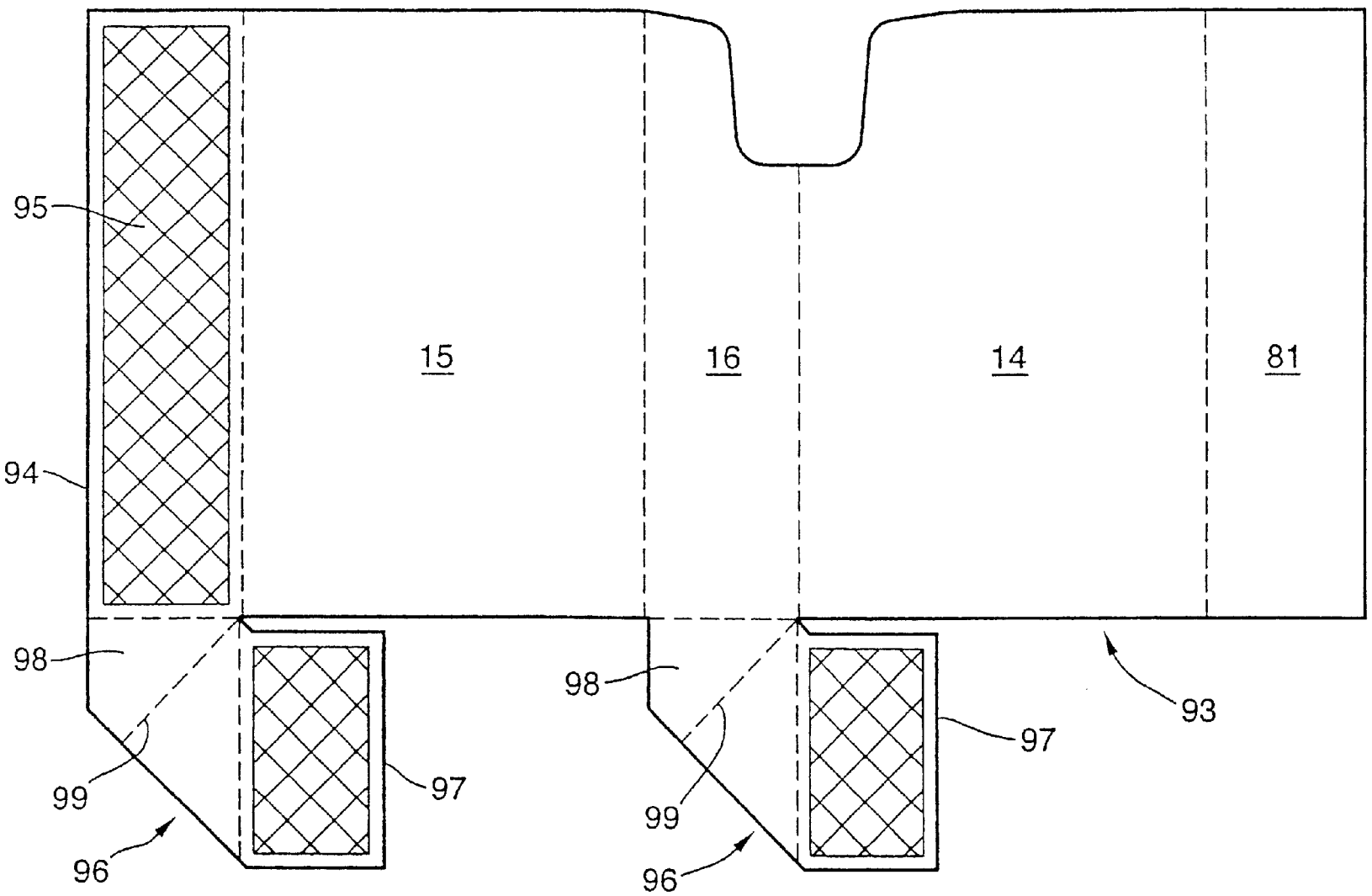

A further embodiment of liner blank 93 is seen in FIG. 12. This liner may be preassembled, sent away in collapsed condition and charged after re-erection. Front and rear liner panels 14, 15 are joined through fold lines to side wall 16. An opposite side wall is formed by flap 81 joined through a fold line to panel 14, to the inner side of which is adhered side flap 94 of the rear panel 15 by adhesive or heat-seal hatched area 95. At the base of each of side wall 16 and flap 94 are L-flaps 96. Each L-flap 96 has an end tab 97 with an adhesive or heat-seal hatched area, the end tab 97 being joined to the side wall or flap by a link 98 which has a 45° angled fold line 99 subtending the right angle produced by the conventional fold lines which define the remaining margins of side flap 94 and end tab 97 respectively.

The end tabs 97 are brought round and adhered to the inner faces of the front and rear wall panels 14, 15 respectively. When the liner is erect in its cuboid state the links 98 will be essentially planar and act as a partial base wall. However, the liner can be collapsed sideways, with the links folding about the lines 99.

Figure 13:
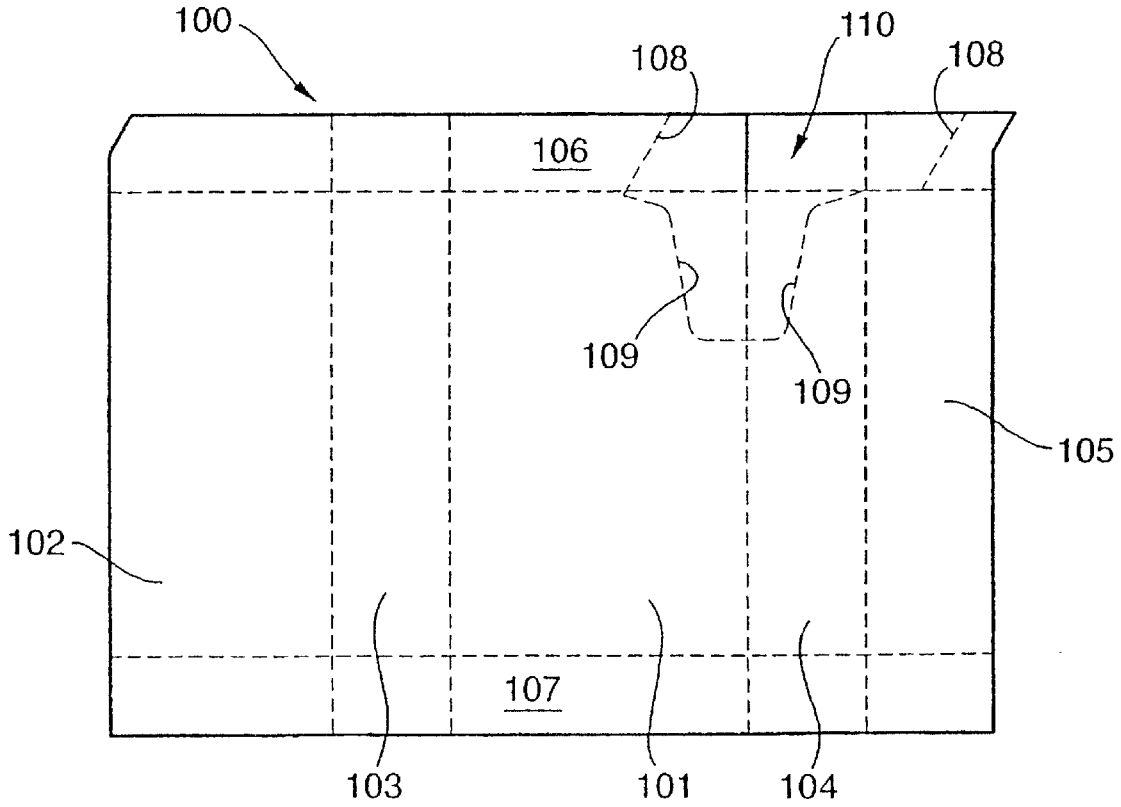
FIG. 13 shows the outer face of a blank of a foil wrap.

The blank 100 of FIG. 13 shows the outer face of a foil wrap for a charge of cigarettes, adapted so that an access opening is provided. Here, that provision is by a removable portion 110 of the wrap.

Front and rear panels 101, 102 are joined by first and second side panels 103, 104 through respective fold lines. Back panel 102 is in two parts 102, 105, which in the assembled state overlap partially. Base-forming and top-forming panels 106, 107 are folded in using diamond or gusset folds. At part of the top which will be at the projecting enclosure, and in the corner between the front and side walls, lines of weakening 1.08 and 109 define a removable portion 110 of the top and of that corner. The user opens the pack, exposes the wrap and pulls that portion 110 so as to expose the charge and so to allow withdrawal of a cigarette.

Although, as stated, any liner may be used with any container body, our presently preferred combination is of the liner of FIG. 10 with the container of FIG. 7.

What is claimed is:

1. A pack for containing smoking articles, the smoking articles having an axis of elongation, said pack comprising:

a body, said body including a major front panel and a major back panel;

a lid hinged to said body about a hinge axis, said hinge axis being parallel to the contained, said hinge axis being located approximately in a plane defined by said major front panel or said major back panel of said body; and a liner located within said body, said liner having front, rear, side and base walls and forming an enclosure for the smoking articles, said enclosure being formed by said front, rear, side, and base walls of said liner, a portion of said liner projecting from one side of said body, said projecting liner portion being closable by said lid in a closed position of said lid, and being accessible in an opened position of said lid, said liner enclosing the smoking articles in said enclosure and forming an access opening for removal of a smoking article from said pack in a direction generally parallel to said hinge axis of said lid.

2. A pack according to claim 1, wherein said front and side walls of said liner are of reduced height adjacent to, and at a corner of said enclosure formed by said front and side walls of said liner.

3. A pack according to claim 2, wherein a front wall of said lid is deeper than a rear wall of said lid and further wherein top and bottom walls of said lid have sloped edges, and top and bottom walls of said body have correspondingly sloped edges whereby said top and bottom walls of said lid and of said body lie edge to edge in the closed position of the lid.

4. A pack according to claim 3, wherein said pack is a cuboid having a major dimension parallel to said hinge axis.

5. A pack according to claim 4, wherein the smoking articles in said pack are at least part foil wrapped.

6. A pack according to claim 5, wherein said foil has a portion defined by a line of weakening so as to be removable at an access opening of the enclosure.

7. A pack according to claim 1, wherein a front wall of said lid is deeper than a rear wall of said lid and further wherein top and bottom walls of said lid have sloped edges, and top and bottom walls of the body have correspondingly sloped edges wherein said top and bottom walls of said lid and of said body lie edge to edge in the closed position of the lid.

8. A pack according to claim 1, wherein said pack is a cuboid having a major dimension parallel to said hinge axis.

9. A pack according to claim 1, wherein the smoking articles in said pack are at least part foil wrapped.

10. A pack according to claim 9, wherein said foil has a portion defined by a line of weakening so as to be removable at an access opening of the enclosure.

* * * * *

UNITED STATES PATENT AND TRADEMARK OFFICE

CERTIFICATE OF CORRECTION

PATENT NO. : 6,435,342 B1
DATED : August 20, 2002
INVENTOR(S) : Hjarald Edgar Agnes It is certified that error appears in the above-identified patent and that said Letters Patent is hereby corrected as shown below:

Column 6,
Line 12, change "the contained" and insert -- axes of the contained smoking articles --.

Signed and Sealed this

Tenth Day of December, 2002

JAMES E. ROGAN
*Director of the United States Patent and Trademark Office*